US005651487A

United States Patent [19]

Hansen

[11] Patent Number: 5,651,487

[45] Date of Patent: Jul. 29, 1997

[54] PAPER TOWEL REMOVAL ACCESSORY

[76] Inventor: Val Hansen, 1411 Fenton St., Apt. 108, Lakewood, Colo. 80214

[21] Appl. No.: 604,853

[22] Filed: Feb. 22, 1996

[51] Int. Cl.[6] ..... B26F 3/02

[52] U.S. Cl. ..... 225/106; 225/84

[58] Field of Search ..... 225/51, 74, 79, 225/84, 85, 106; 403/362, 374, 343, 256, 261; 242/419.4, 419, 598.3; 206/409

[56] References Cited

U.S. PATENT DOCUMENTS

| | | | |
|---|---|---|---|
| 424,788 | 4/1890 | Hubbell . | |
| 429,029 | 5/1890 | Geltz | 225/85 X |
| 429,566 | 6/1890 | Ford et al. | 225/85 X |
| 525,483 | 9/1894 | Bodley | 225/85 X |
| 1,064,596 | 6/1913 | Bengston | 225/85 X |
| 1,243,569 | 10/1917 | Taylor . | |
| 1,325,300 | 12/1919 | Kundtson | 225/79 X |
| 1,947,340 | 2/1934 | Hallwood . | |
| 2,818,221 | 12/1957 | Thieman . | |
| 4,454,974 | 6/1984 | Cooke | 225/106 |
| 4,634,033 | 1/1987 | Lloyd . | |
| 4,771,966 | 9/1988 | Anderson | 225/51 |
| 5,054,675 | 10/1991 | Taves | 225/79 X |
| 5,464,359 | 11/1995 | Whitty | 403/362 X |

FOREIGN PATENT DOCUMENTS

| | | | |
|---|---|---|---|
| 73768 | 5/1917 | Switzerland | 242/598.3 |

*Primary Examiner*—Kenneth E. Peterson
*Attorney, Agent, or Firm*—Lee R. Osman; Holland & Hart LLP

[57] ABSTRACT

A paper towel removal accessory for use in removing only the desired number of paper towels at a time from a roll of paper towels. The roll of paper towels is rotatably mounted on a paper towel holder, the paper towel holder being mounted on a support surface. This accessory invention is designed to provide an efficient and reliable device to control and deliver exactly the number of paper towels desired by the user and to do it in single-handed operation. It works equally well with either vertical or horizontal installations, and it is equally efficient when applied with most commercial paper towel holders currently in use and available.

1 Claim, 4 Drawing Sheets

PAPER TOWEL REMOVAL ACCESSORY

BACKGROUND OF THE INVENTION

1. Field of the Invention

This invention relates to a new and improved accessory for use in removing paper towels from a paper towel roll when mounted on a paper towel holder, and more particularly to a paper towel removal device having a riser and a brake wherein positioning of the paper towel between the riser and the brake facilitates the removal of only the desired number of paper towels.

2. Description of the Prior Art

Paper towels are used in virtually every household for a great variety of purposes. Many times paper towels are found not only in a household's kitchen, but also in the garage, shop, utility and laundry rooms. Paper towel rolls are typically 11 inches in length, each roll consists of several hundred towels, separated by perforations, wrapped around a hollow cardboard cylindrical core.

Common paper towel holders are able to be easily mounted in many places, such as under cabinets and on walls. Most types of popular paper towel holders for holding rolls of paper towels include a flat base portion having fold-out flaps at either end of the base portion. When the fold-out flaps are unfolded, they extend at a 90° angle from the base portion. Typically this style of paper towel holder is mounted under a cabinet with the base portion attached to the cabinet and the flaps extending downwardly.

Removing either a single paper towel or a plurality of paper towels at once from a roll of paper towels from such a dispenser, without unrolling unwanted paper towels from the roll, can be a difficult task. Typically, individual paper towels on a roll are delineated by perforations through the paper towel. If the perforation is not positioned correctly, or if the user pulls in the wrong direction, not only will the paper towel not separate from roll, but several sheets of paper towels can be unrolled from the roll. Sometimes the desired paper towel can be removed from the roll, but several sheets of paper towels are still unrolled. This occurrence requires that the paper towels be re-rolled onto the paper towel roll, which is a tedious and sometimes difficult task.

Alternatively, the user can pull the desired length of paper towels off the roll with one hand and hold the roll stationary with the other hand while tearing off the desired length. This is extremely inconvenient when the user is working at some task and may have his hands wet or otherwise occupied.

Accordingly, there is a need in the art for a paper towel separator accessory for use with common paper towel holders that allow the desired number of paper towel sheets to be removed from the paper towel roll without causing several unwanted sheets to unroll therefrom. It is against this background that the significant improvements and advancement of the present invention have taken place in the field of paper towel roll accessories.

SUMMARY OF THE INVENTION

It is an object of the present invention to provide a paper towel removal accessory which allows a user to remove only the desired number of paper towels from the paper towel roll.

It is another object of the present invention to provide a paper towel removal accessory which is used in conjunction with existing paper towel holders mounted in either a horizontal or vertical direction.

The invention is embodied in a paper towel removal accessory for use in removing only the desired number of paper towels at a time from a roll of paper towels. The row of paper towels is rotatably mounted on a paper towel holder, the paper towel holder being mounted on a support surface. The accessory includes an elongated riser defining a cylindrical cavity along its length, and having opposing ends, each end forming an aperture extending radially therethrough, and a flat elongated blade having an inner longitudinal edge and an outer longitudinal edge, and having opposing ends, each end forming an aperture extending therethrough. A pair of spacers, each defining an aperture are also provided, along with a pair of elongated rods, each having an upper end and a lower end, each of the upper ends defining an eye and being pivotally attached to the support surface, by means of two screw hooks.

Each of the rods is positioned through an aperture at the ends of the riser, and are each received through the aperture formed in one of the spacers, and are each received through the apertures at the ends of the blade, such that the riser rests on the spacers which rest on said blade to form a gap between said riser and said blade. A pair of fasteners, one fastened on each of said lower ends of said rods to attach the riser, spacer and blade to said rods.

In use, the accessory is pivotally attached to the support surface so that the inner longitudinal edge of the blade rests against the paper towels when at rest. The paper towels are threaded through the gap between the riser and the blade to extend therethrough. The perforations between adjacent paper towels is positioned just beyond, say by an inch, the outer longitudinal edge of the blade, and then moved downwardly in a sudden manner. The inner longitudinal edge forced against the paper towel holder to keep the paper towel roll from rotating on the holder. This concentrates the tearing force in the perforations, which results in the select number of paper towels being removed from the roll.

The accessory is designed in a spirit of cooperation and not one of competition with available or already installed paper towel holders. The accessory is of unique simplicity, and is designed to solve a problem which has met with no solution in the marketplace.

A more complete appreciation of the present invention and its scope can be obtained from understanding the accompanying drawings, which are briefly summarized below, the following detailed description of the presently preferred embodiment of the invention, and the appended claims.

DETAILED DESCRIPTION OF THE INVENTION

Figure 1:
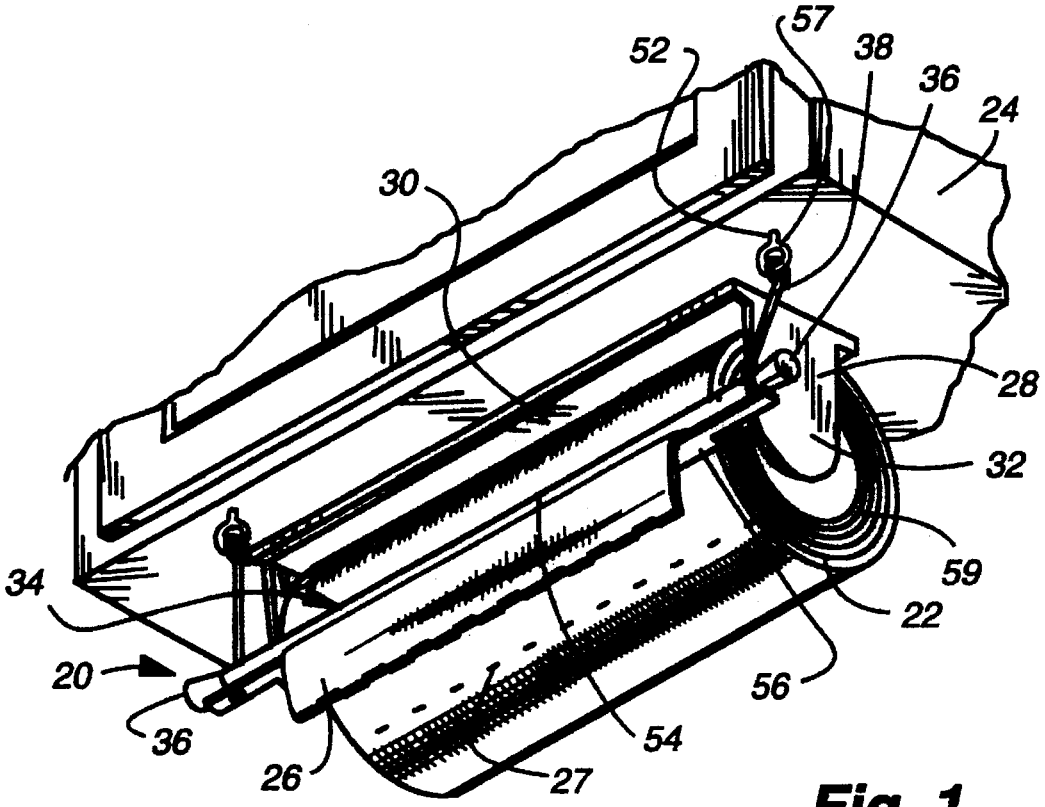
FIG. 1 is a perspective view of the removal accessory of the present invention in a horizontal installation, and illustrates the engagement apparatus suspended by a pair of rods from a cabinet, the engagement apparatus engaging a roll of paper towels also attached to the cabinet, and a portion of the paper towel roll extending through a gap in the cutting apparatus.

The paper towel removal accessory 20 of the present invention is shown in FIG. 1, and is shown in use with a paper towel roll 22 mounted on a holder 28 underneath a cabinet 24. The paper towel roll consists of several hundred towel sheets 26 separated by perforations 27, the sheets being wrapped around a hollow cardboard cylinder (not shown). The paper towel roll is mounted on a standard paper towel holder 28 having a base portion 30 which is attached to the underside of the cabinet 24, and downwardly extending flaps 32 (only one shown) for rotatably engaging the cardboard cylinder to allow the paper towel holder 22 to rotate about its longitudinal axis to dispense the paper towels 26.

Referring still to FIG. 1, the paper towel removal accessory 20 includes an engagement apparatus 34 attached at either end 36 to rods 38 used to position the engagement apparatus 34 in moving engagement with the paper towel roll 22. The rods 38 are pivotally mounted to the underside of the cabinet 24 adjacent to the paper towel holder 28 so that the engagement apparatus 34 is in continuous engagement with the paper towel roll 22.

The paper towels 22 are threaded through the engagement apparatus 34 so that a user can grip the extending paper towel sheet 26 to unroll the desired number of sheets to be removed from the roll 22. The user pulls the desired length of towels 26 through the engagement apparatus 34. The user positions the perforation 27 at which the selected towels 26 are to be separated from the roll 22, and positions that perforation 27 slightly outside of the engagement apparatus 34 away from the roll 22. The user can then tear off the selected towels 26 from the roll 22 by pulling down on the towel diagonally, causing the engagement apparatus 34 to engage the paper towel roll 22 to keep it from rotating (see FIGS. 5 and 6), and also concentrating the force applied to the perforation to easily and efficiently remove only the desired number of paper towels.

In more detail as shown in FIG. 1, the paper towel removal accessory 20 comprises an engagement apparatus 34 suspended in engagement with the paper towel roll 22 by a pair of rods 38, as shown in FIG. 1. The rods 38 have elongated main body members 42, each having an upper end 44 defining an eye 46, and a threaded lower end 48 (See FIG. 7) for receiving a threaded fastener 50, such as a nut. The rods 38 are pivotally attached to the surface on which the paper towel holder 28 is mounted by attaching a screw-hook 52 for each rod 38 to the surface, and releasably engaging the eyes 46 at the upper end 44 of the rods 38 in the screw-hook 52.

The screw-hooks 52 need to be positioned adjacent the paper towel holder 28 and above the paper towel roll 22 with their gap 57 oriented away from the side to which the engagement apparatus is suspended. The cutting apparatus 34 hangs at an angle and is in engagement with the paper towel roll 22 when at rest, as shown in FIG. 1. The engagement apparatus 34 is held against the paper towel roll 22 by gravity, and can swing freely away from the paper towel roll 22, or be more forcefully engaged with the paper towel roll 22, by a force applied in the appropriate direction.

Figure 7:
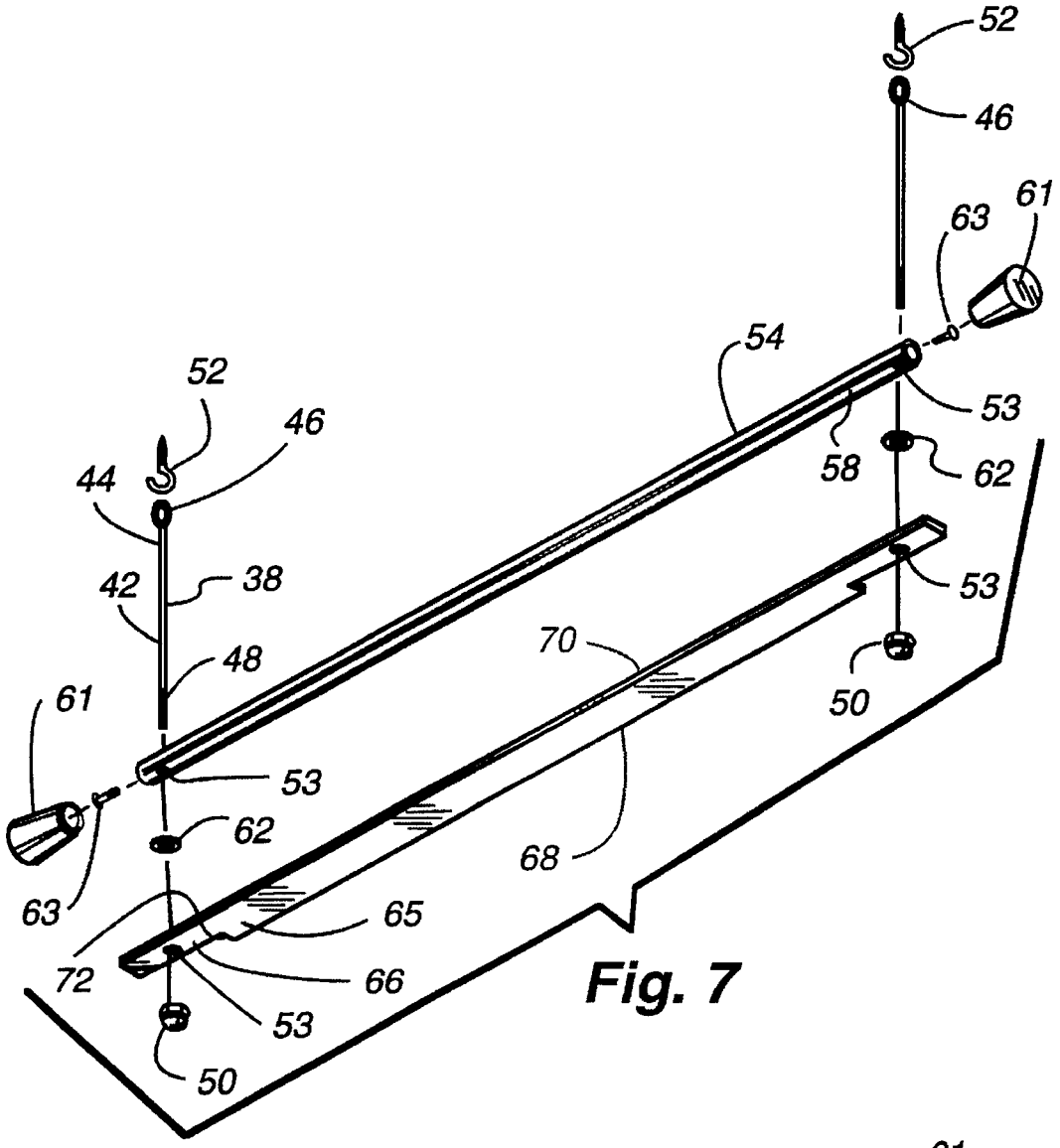
FIG. 7 is an exploded view of the removal accessory of the present invention.
Figure 8:
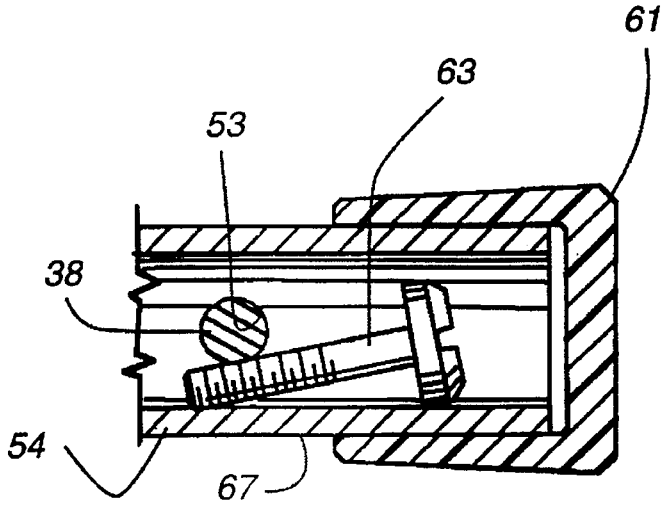
FIG. 8 is an enlarged section taken along line 8—8 of FIG. 1.
Figure 2:
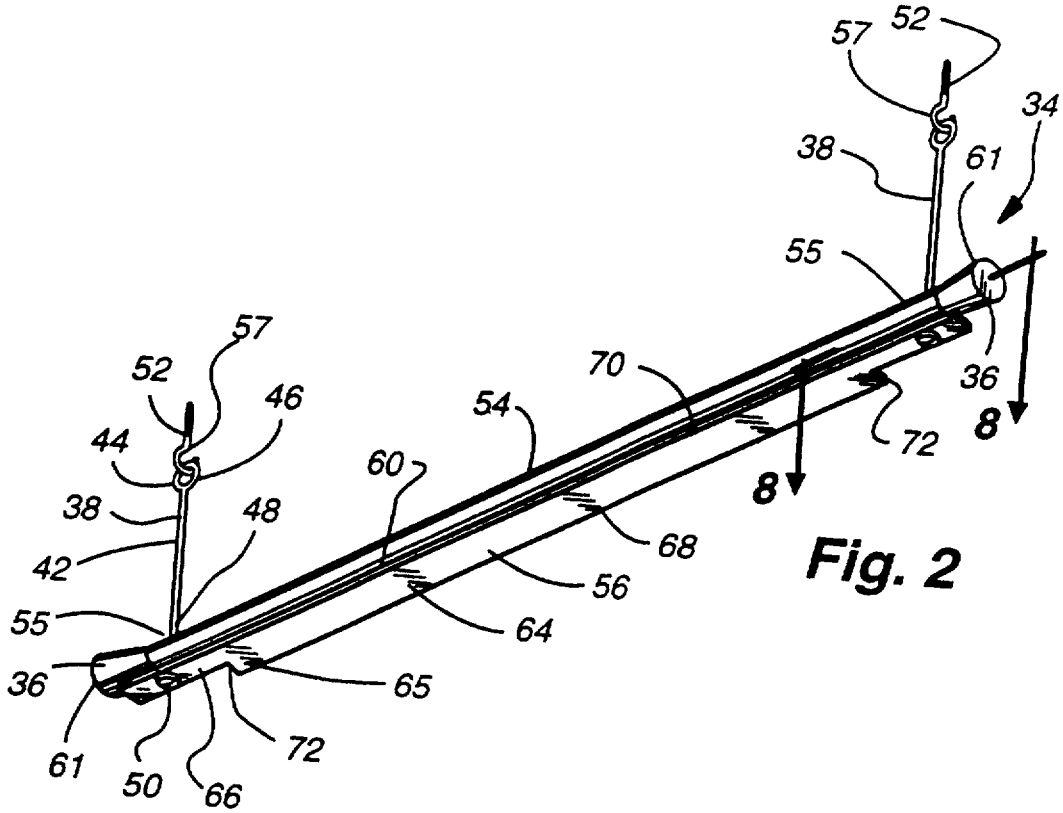
Figure 1:
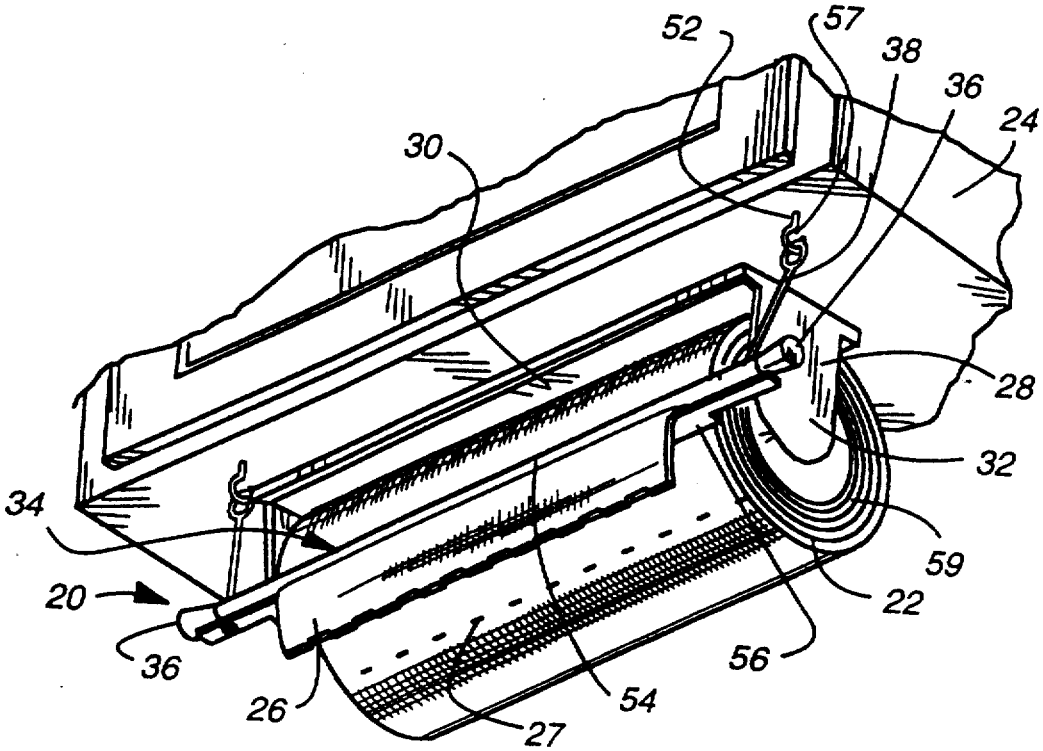
Figure 3:
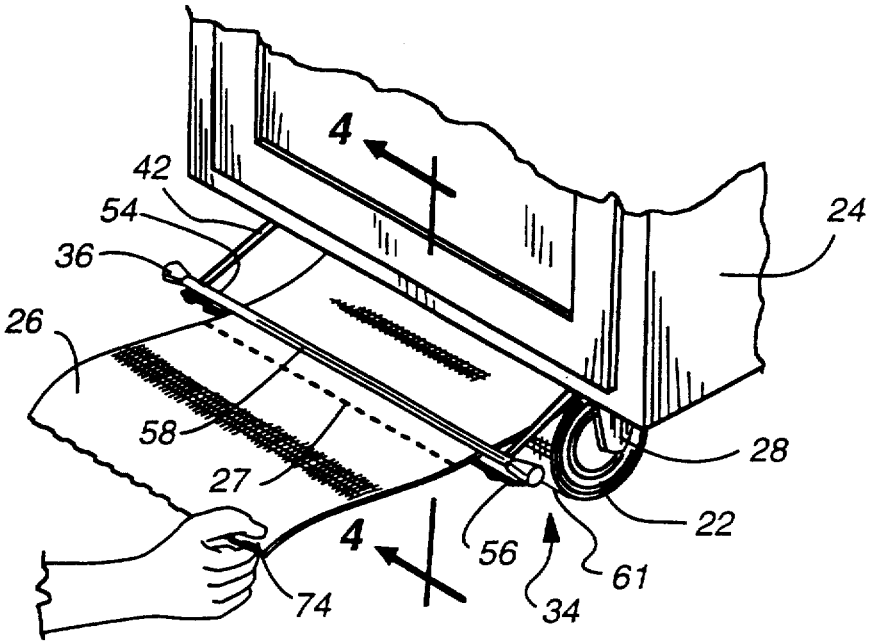
Figure 4:
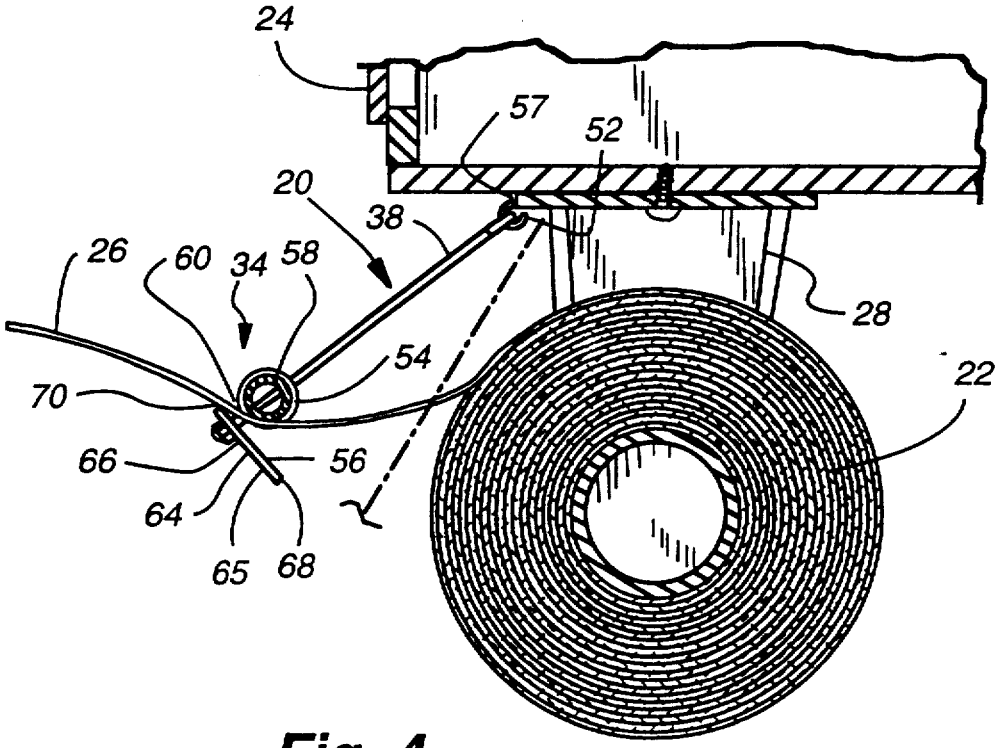
Figure 5:
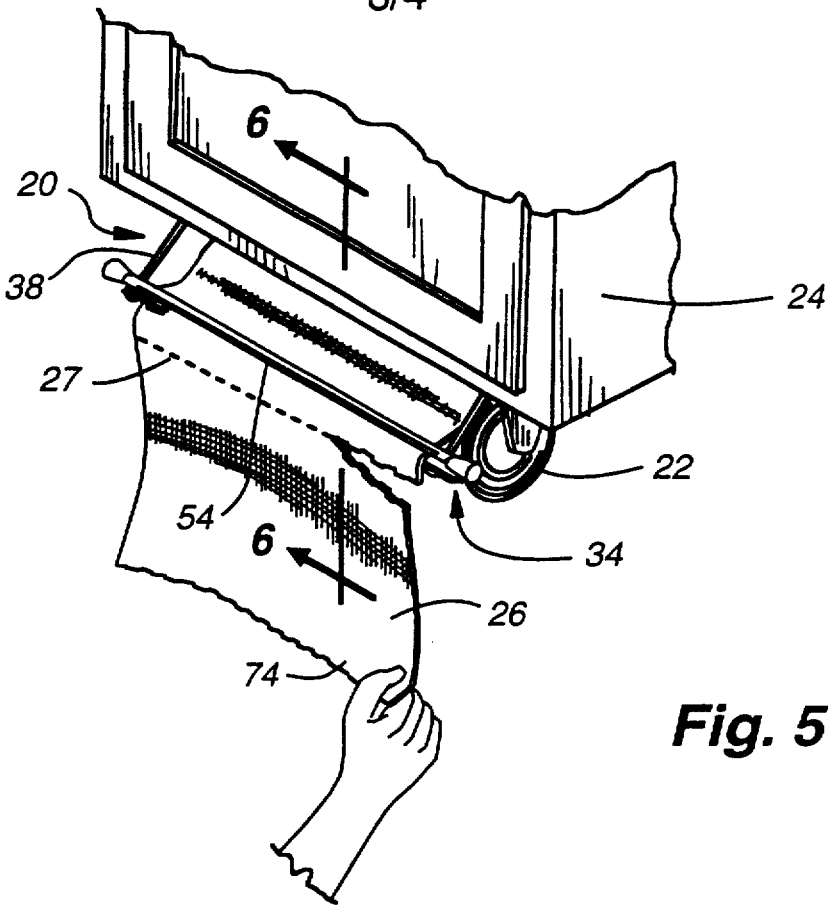
Figure 6:
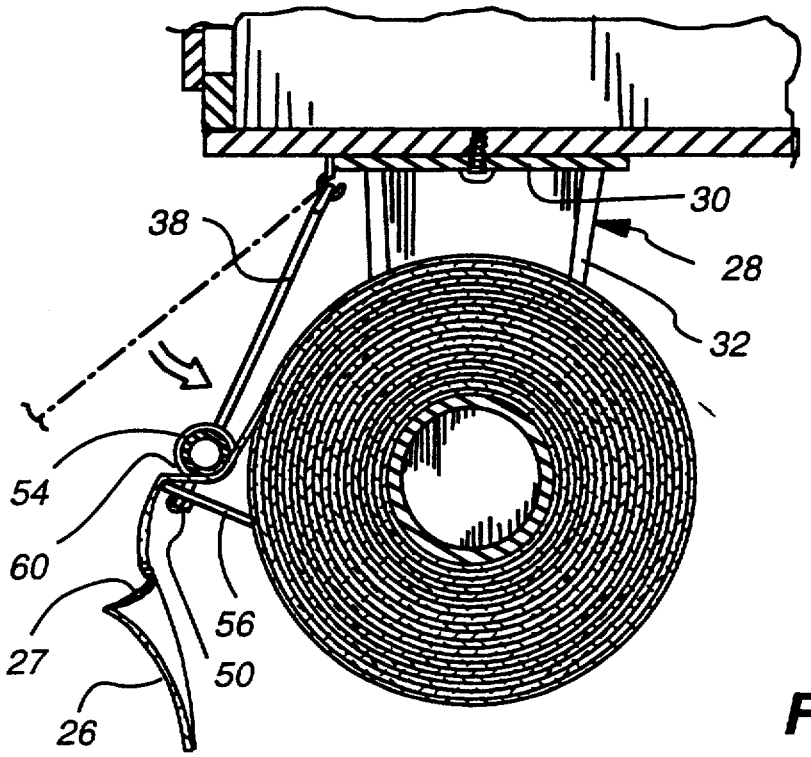
Figure 7:
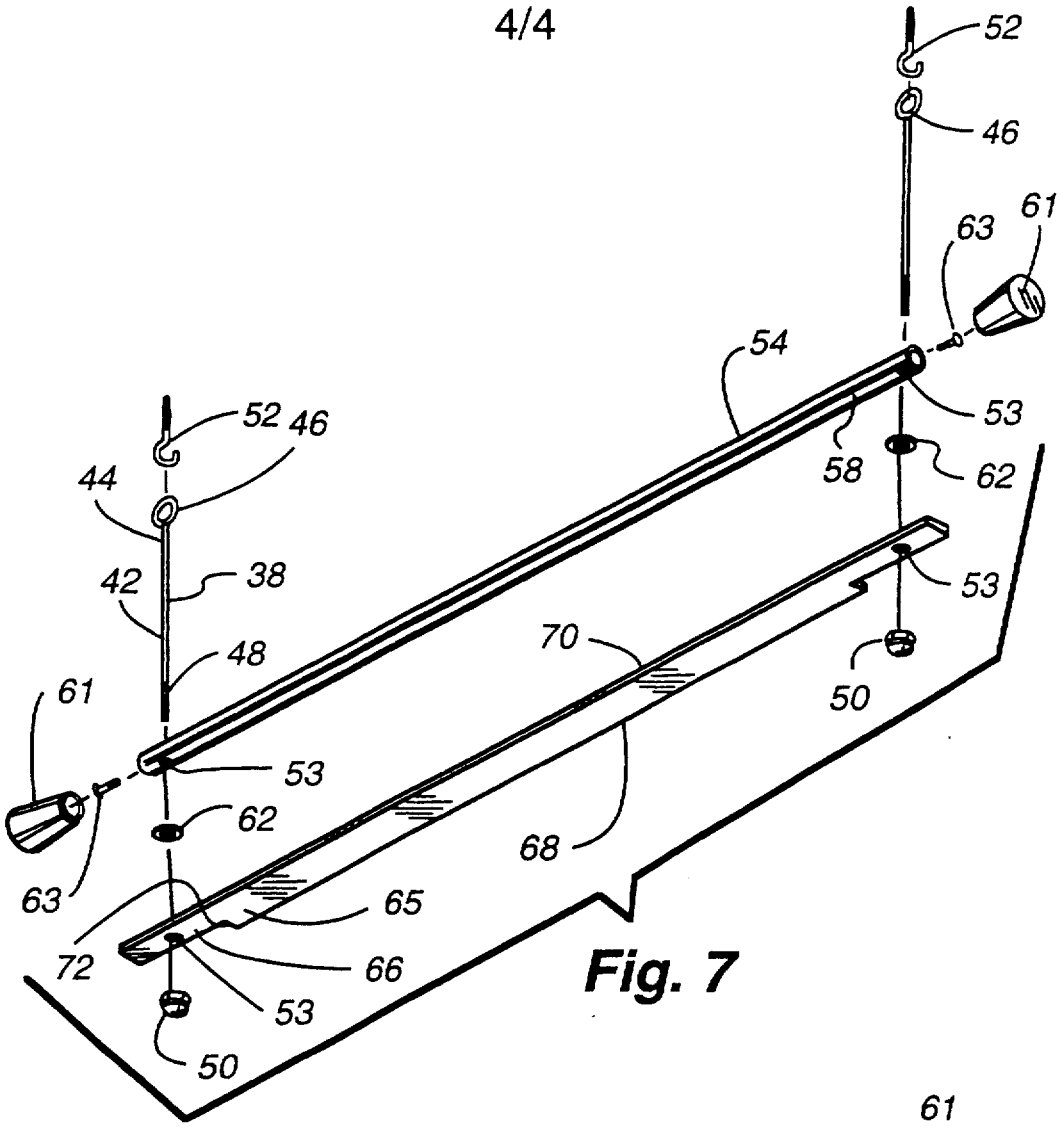
Figure 8:
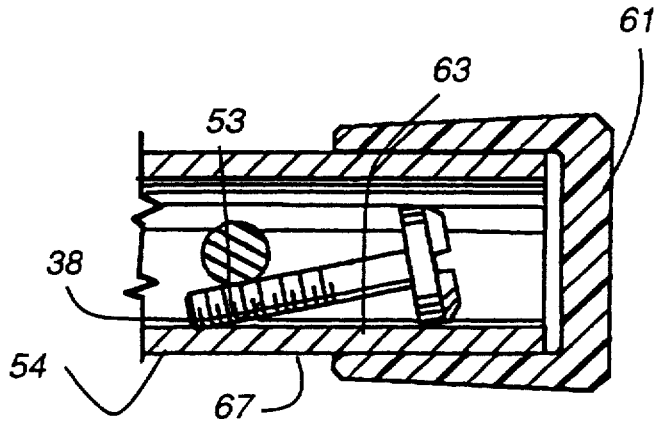

The lower ends 48 of the rods 38 are attached to opposing ends 36 of the engagement apparatus 34 by positioning the lower ends 48 through apertures 53 formed in the engagement apparatus 34 (See FIG. 7). The cutting apparatus 34 is secured from slipping off of the rods 38 by the threaded fastener 50 threaded onto the lower ends 48. The engagement apparatus 34 engages the fastener 50 and is kept from slipping off of the rods 38. The engagement apparatus is kept from moving up on the rods 38 by jam screws 63. The jam screws 63 are placed between the rods 38 and the walls 67 of the riser 54 inside the riser 54 to create a frictional fit between the rods 38 and the apertures 53 so that the riser 54 does not slide up on the rods 38, as best shown in FIG. 8.

The engagement apparatus 34 includes a riser 54 and a brake 56. The riser 54 has an elongated, rigid cylindrical shape defining opposing ends 55, and is mounted on the rods 38 above the brake 56. The riser 54 is longer than the roll of paper towels 22 to allow the rods 38 to be attached to the riser 54 at a spaced-apart dimension greater than the length of the paper towel roll 22, to facilitate attaching the rods 38 adjacent but outwardly of the ends 59 of the paper towel roll 22, as shown in FIG. 1.

Figure 4:
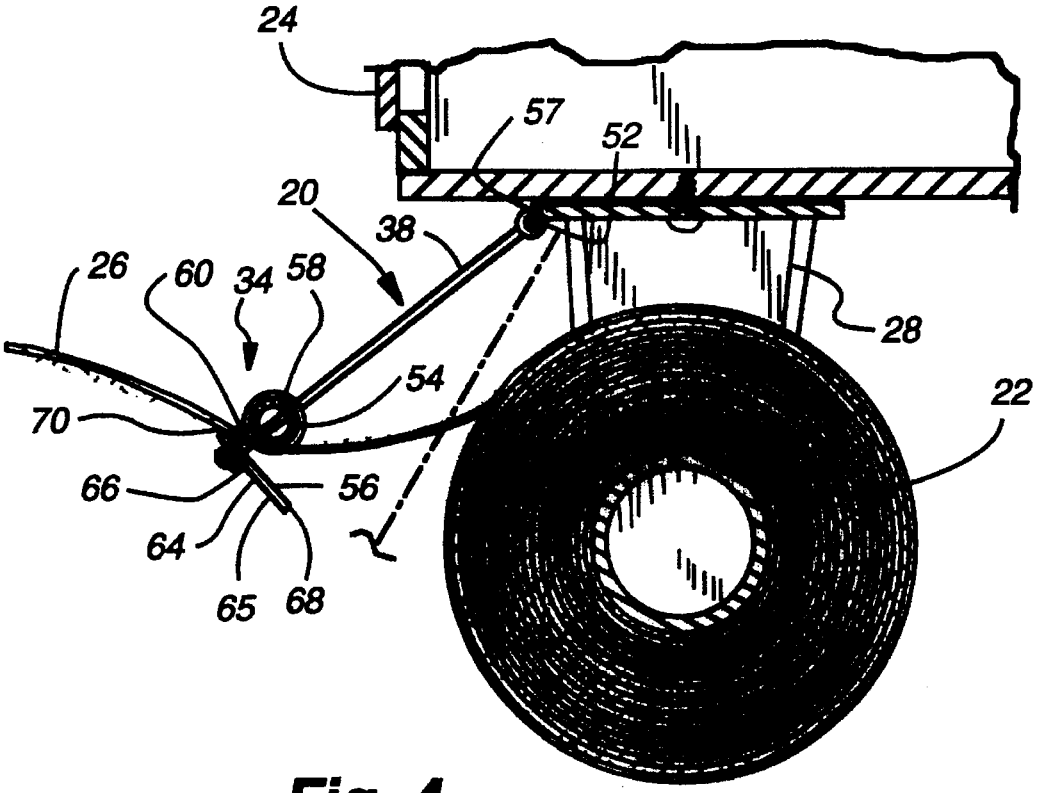
FIG. 4 is an enlarged section taken along line 4—4 of FIG. 3.
Figure 6:
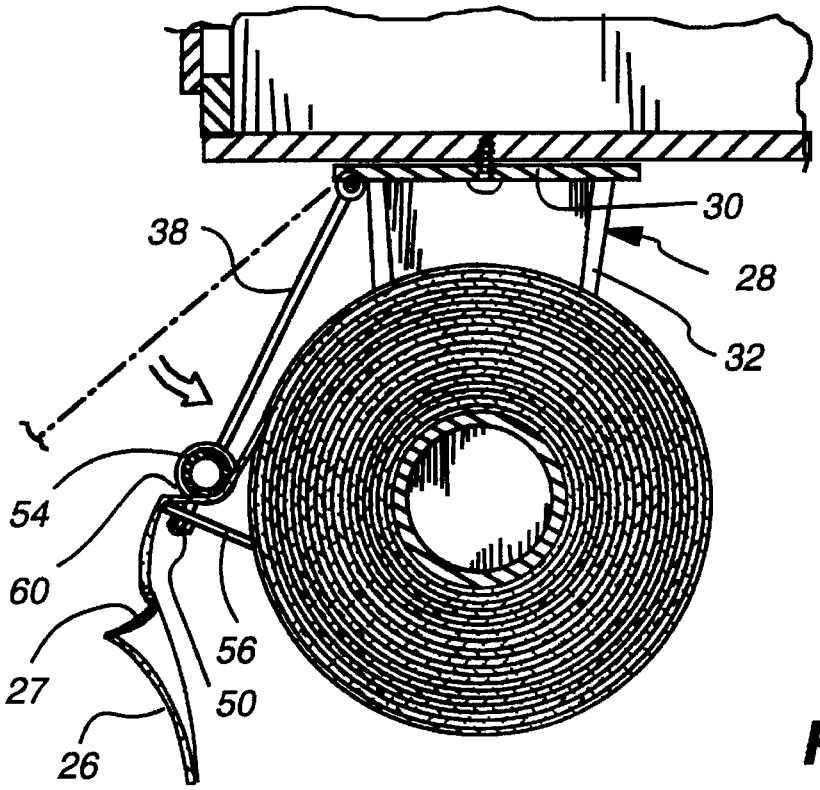
FIG. 6 is an enlarged section taken along line 6—6 of FIG. 5.

The rods 38 pass through the riser 54, as shown in FIGS. 4 and 6. The riser 54 has a smooth outer surface 58 to facilitate movement of the sheet 26 over the surface, as will be described hereinafter. The riser 54 is spaced away from the brake 56, forming a gap 60, by a spacer 62 or washer positioned on the rod 38 between the brake 56 and riser 54. The dimension of the gap 60 formed between the riser 54 and the brake 56 must be slightly larger than the thickness of the paper towel sheets 26 with which the accessory 20 is used. The riser 54 has end caps 61 for placement on the ends 55 of the riser to reduce the chances of damage if an item strikes the riser 54 during use.

The brake 56 has an elongated, rigid and flat main body 64, and defines first 65 and second 66 integrally formed lengthwise portions, the first portion 65 defining an inner longitudinal edge 68, and the second portion defining an outer longitudinal edge 70. The brake 56 is wider than the riser 54. The brake 56 is positioned on the rods 38 below the riser 54 such that the outer longitudinal edge 70 is flush with the outer surface 58 of the riser 54 in a line parallel to the length of the rods 38 when attached to the engagement apparatus 34. The first portion 65 extends past the riser 54 towards the paper towel roll 22 to insure engagement with the paper towel roll 22 without interference from the riser 54.

The second portion 66 of the brake 56 is substantially the same length as the riser 54, and thus is longer than the length of the roll of paper towels 22. The length of the second portion 66 is important because it must be long enough to be secured to the rods 38, which are spaced apart by a distance greater than the length of the paper towel holder 28. The first portion 65, and associated longitudinal edge 68, are shorter than the length of the paper towel roll 22, thus forming a step feature 72 in the width dimension of the brake. The shorter first portion 65 of the brake 56 allows the accessory 20 to be used without interfering with the flaps 32 of the paper towel holder 28 when there are very few paper towels 26 left on the roll 22.

In operation, as shown in FIGS. 3–6, the accessory 20 is mounted adjacent to the paper towel roll 22 such that the inner longitudinal edge 68 of the engagement apparatus 34 is in engagement with the paper towel roll 22 regardless of the number of paper towels 26 on the roll 22, as shown in FIGS. 1 and 6. The accessory hangs from the screw-hooks 52 in a slanted orientation, thus insuring engagement between the inner longitudinal edge 68 of the brake 56 and the paper towel roll 22. The accessory 20 is able to freely pivot upwardly away from the paper towel roll 22, and automatically pivots downwardly to stay in engagement with the paper towel roll 22 as paper towels 26 are removed therefrom.

A paper towel 26 is then threaded through the gap 60 between the riser 54 and the brake 56 to an extent sufficient to provide enough paper towel 26 to grip for use, as best seen in FIG. 1.

Figure 3:
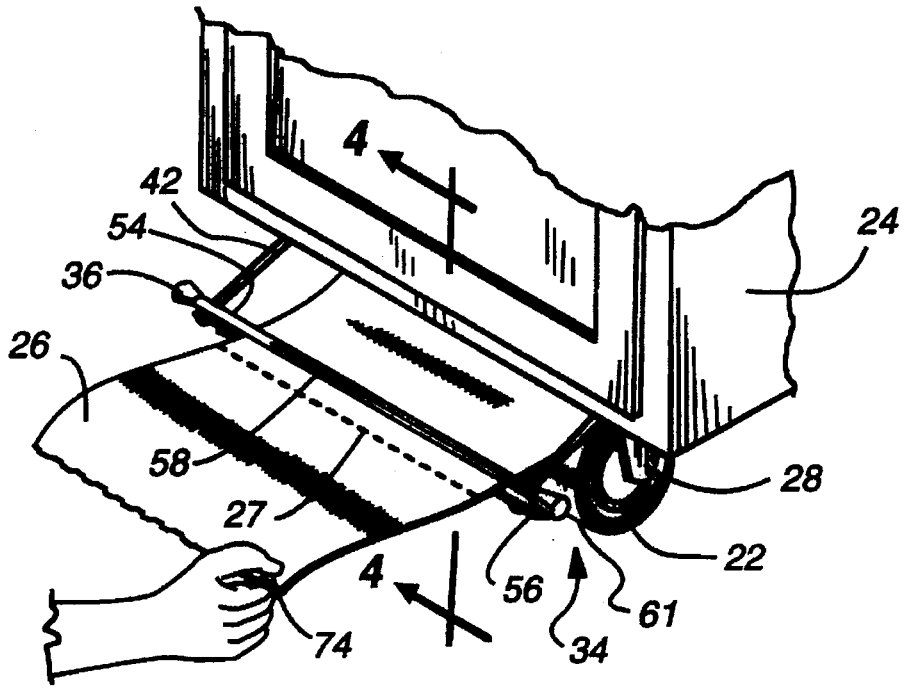
FIG. 3 is a perspective view of the removal accessory of the present invention, and illustrates a portion of paper towel sheets extending through the engagement apparatus prior to being removed from the paper towel roll.

Referring to FIGS. 3 and 4, the user next grips the paper towel 26 extending through the gap 60 and unrolls the number of towel sheets 26 desired from the paper towel roll 22 through the gap 60 between the riser 54 and brake 56. As the user pulls the paper towels 26 through the gap 60 of the engagement apparatus 34, the paper towels 26 slide over the smooth outer surface 58 of the riser 54 and lift the riser 54 upwardly, causing the engagement apparatus 34 to pivot upwardly and away from the paper towel roll 22. This movement of the engagement apparatus 34 also acts to disengage the inner longitudinal edge 68 of the brake 56 from the roll 22, allowing the paper towel roll to rotate more freely. The movement of the engagement apparatus 34 when the paper towels 26 are being withdrawn straightens out the path of the towel through the gap 60 in the engagement apparatus 34 which allows the paper towels 26 to be withdrawn more easily.

The user withdraws the number of paper towels desired, shown in FIG. 3 to be one towel 26, and positions the last paper towel 26 to be removed such that the perforation 27 to be torn is spaced away from the outer longitudinal edge 70 of the brake 56 by a predetermined distance, for instance about an inch. The paper towel 26 is now ready to be torn at the selected perforation 27.

Figure 5:
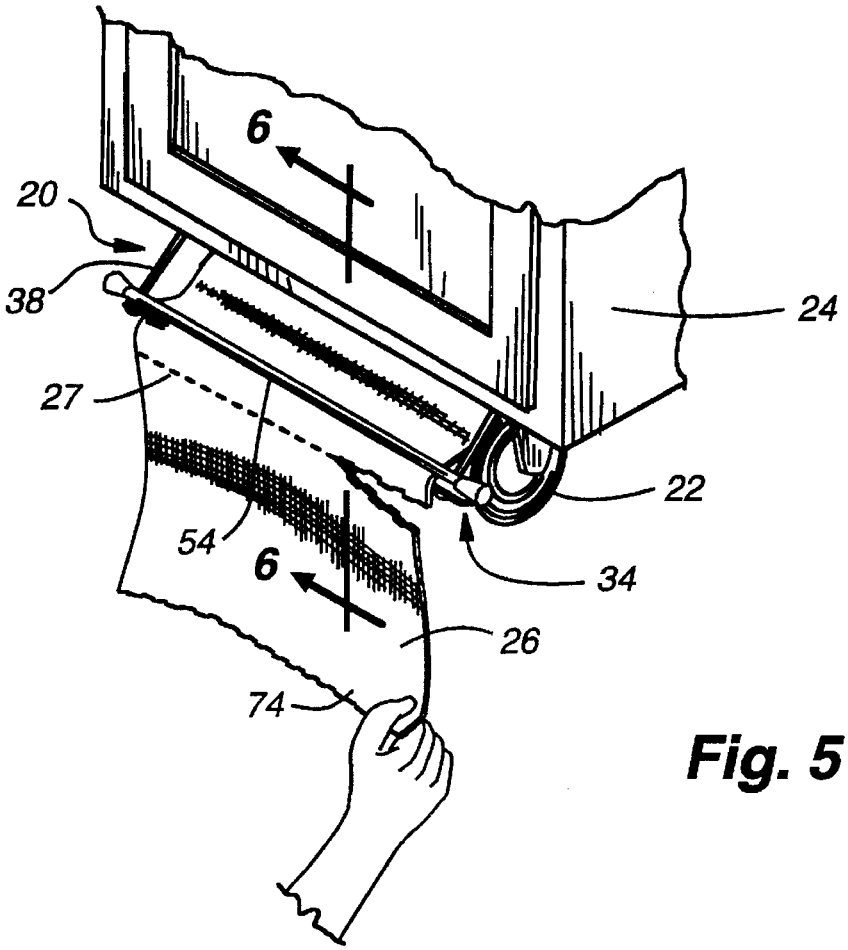
FIG. 5 is a perspective view of the removal accessory of the present invention, and illustrates a portion of paper towel sheets extending through the engagement apparatus and being torn from the paper towel roll.

Referring to FIGS. 5 and 6, the removal, or tearing, procedure is indicated. Once the perforation 27 to be torn is positioned outwardly of the outer longitudinal edge 70 of the brake 56, the user allows the engagement apparatus 34 to engage the roll of towels 22 such that the inner longitudinal edge 68 of the brake 56 engages the roll of towels 22. At this point, the user grasps with one hand the last whole sheet 26 at a lower corner 74, as shown in FIG. 5, and pulls downwardly and to the side, thus forcing the inner longitudinal edge 68 to smartly engage the paper towel roll 22 and act as a brake to keep the towel roll 22 from rotating.

The braking action of the brake 56 concentrates the force of the tearing motion at the perforations 27 (the weakest point on the towel), to cause the perforation to tear efficiently, resulting in a cleanly and easily removed paper towel sheet 26. The braking effect of the brake 26 eliminates the unrolling of more paper towels than is desired during the tearing process. A sufficient length of paper towel 26 is left extending from the gap 60 for the user to grasp for tearing the next paper towel.

The components of this invention can be made of metal or plastic of suitable strength.

A presently preferred embodiment of the present invention and many of its improvements have been described with a degree of particularity. It should be understood that this description has been made by way of preferred example, and that the invention is defined by the scope of the following claims.

What is claimed is:

1. A paper towel removal accessory for use in removing a desired number of paper towels from a roll of paper towels, the paper towel roll changing from substantially full to substantially empty by the removal of paper towels therefrom, rotatably mounted on a commercial paper towel holder, with the paper towels extending off of the top of the roll of paper towels, the paper towel holder having a base member defining opposing ends, and a flap mounted at each of said ends and extending outwardly from the base member to rotatably engage the paper towel roll, each flap defining a peripheral edge, the paper towel holder being mounted on a support surface; the accessory comprising:

a. a first and second elongated rods, each of said rods having an upper end and a lower end, said upper end of each of said rods being pivotally attached to the support surface, the upper end of each of said rods adjacent to an opposing end of the paper towel holder;

b. an engagement apparatus having a riser and a blade, the blade spaced away from and below said riser, said riser being an elongated tube having opposing ends and defining an aperture formed through each of said ends of said riser, said blade being an elongated slat having opposing ends and defining an aperture formed through each of said ends of said slat, said blade defining an inner edge, and a step formed on the inner edge at each of said opposing ends of said blade, said riser and said blade positioned with respect to one another such that said aperture at each end of said riser is positioned in coextensive alignment with said aperture at each end of said blade;

c. said lower ends of each of said rods being positioned through said coextensively aligned apertures in each opposing end of said riser and each opposing end of said blade;

d. a fastener releasably attached to the lower end of each of said rods to arrest the downward movement of said engagement apparatus along said rods;

e. means positioned at said opposing ends of said riser to restrict the upward movement of the riser and the blade along said rods, f. the engagement apparatus pivotable about said upper end of each of said rods to a lower position, wherein said inner edge of said blade engages said paper towel roll, each stop at each of said ends of said inner side of said blade forming a notch for receiving the peripheral edge of the adjacent flap when the engagement apparatus is pivoted to said lower position with said inner edge of said blade engaging said paper towel roll when the paper towel roll is substantially empty; and g. the extending paper towel positioned through said space formed between said riser and said blade.

* * * * *

UNITED STATES PATENT AND TRADEMARK OFFICE

CERTIFICATE OF CORRECTION

PATENT NO. : 5,651,487
DATED : July 29, 1997
INVENTOR(S) : Val Hansen

It is certified that error appears in the above-identified patent and that said Letters Patent is hereby corrected as shown below:

The title page, should be deleted to appear as per attached title page.

The sheets of drawings consisting of figures 1-8 should be deleted, to appear as per attached figures 1-8.

United States Patent [19]

Hansen

[11] Patent Number: 5,651,487

[45] Date of Patent: Jul. 29, 1997

[54] PAPER TOWEL REMOVAL ACCESSORY

[76] Inventor: Val Hansen, 1411 Fenton St., Apt. 108, Lakewood, Colo. 80214

[21] Appl. No.: 604,853

[22] Filed: Feb. 22, 1996

[51] Int. Cl.[6] ..... B26F 3/02

[52] U.S. Cl. ..... 225/106; 225/84

[58] Field of Search ..... 225/51, 74, 79, 225/84, 85, 106; 403/362, 374, 343, 256, 261; 242/419.4, 419, 598.3; 206/409

[56] References Cited

U.S. PATENT DOCUMENTS

| | | | |
|---|---|---|---|
| 424,788 | 4/1890 | Hubbell . | |
| 429,029 | 5/1890 | Geltz | 225/85 X |
| 429,566 | 6/1890 | Ford et al. | 225/85 X |
| 525,483 | 9/1894 | Bodley | 225/85 X |
| 1,064,596 | 6/1913 | Bengston | 225/85 X |
| 1,243,569 | 10/1917 | Taylor . | |
| 1,325,300 | 12/1919 | Kandtson | 225/79 X |
| 1,947,340 | 2/1934 | Hallwood . | |
| 2,818,221 | 12/1957 | Thieman . | |
| 4,454,974 | 6/1984 | Cooke | 225/106 |
| 4,634,033 | 1/1987 | Lloyd . | |
| 4,771,966 | 9/1988 | Anderson | 225/51 |
| 5,054,675 | 10/1991 | Taves | 225/79 X |
| 5,464,359 | 11/1995 | Whitty | 403/362 X |

FOREIGN PATENT DOCUMENTS

| | | | |
|---|---|---|---|
| 73768 | 5/1917 | Switzerland | 242/598.3 |

*Primary Examiner*—Kenneth E. Peterson

*Attorney, Agent, or Firm*—Lee R. Osman; Holland & Hart LLP

[57] ABSTRACT

A paper towel removal accessory for use in removing only the desired number of paper towels at a time from a roll of paper towels. The roll of paper towels is rotatably mounted on a paper towel holder, the paper towel holder being mounted on a support surface. This accessory invention is designed to provide an efficient and reliable device to control and deliver exactly the number of paper towels desired by the user and to do it in single-handed operation. It works equally well with either vertical or horizontal installations, and it is equally efficient when applied with most commercial paper towel holders currently in use and available.

1 Claim, 4 Drawing Sheets

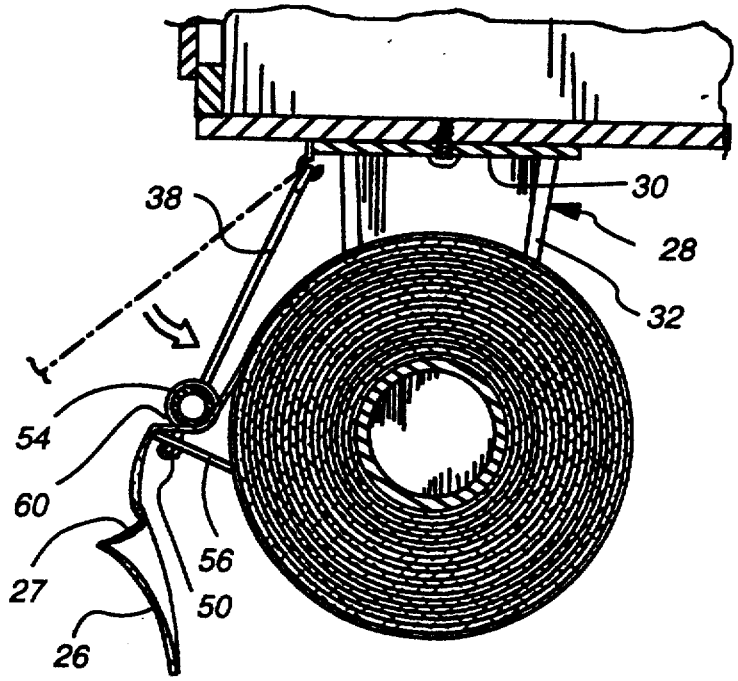

1/4

2/4

4/4

UNITED STATES PATENT AND TRADEMARK OFFICE

CERTIFICATE OF CORRECTION

PATENT NO. : 5,651,487

DATED : July 29, 1997

INVENTOR(S) : Val HANSEN

It is certified that error appears in the above-identified patent and that said Letters Patent is hereby corrected as shown below:

Column 3, line 8: Replace "1" with --2--.

Fig. 1: Reference #52 is screw hook, not eyelet.

Figure 2:
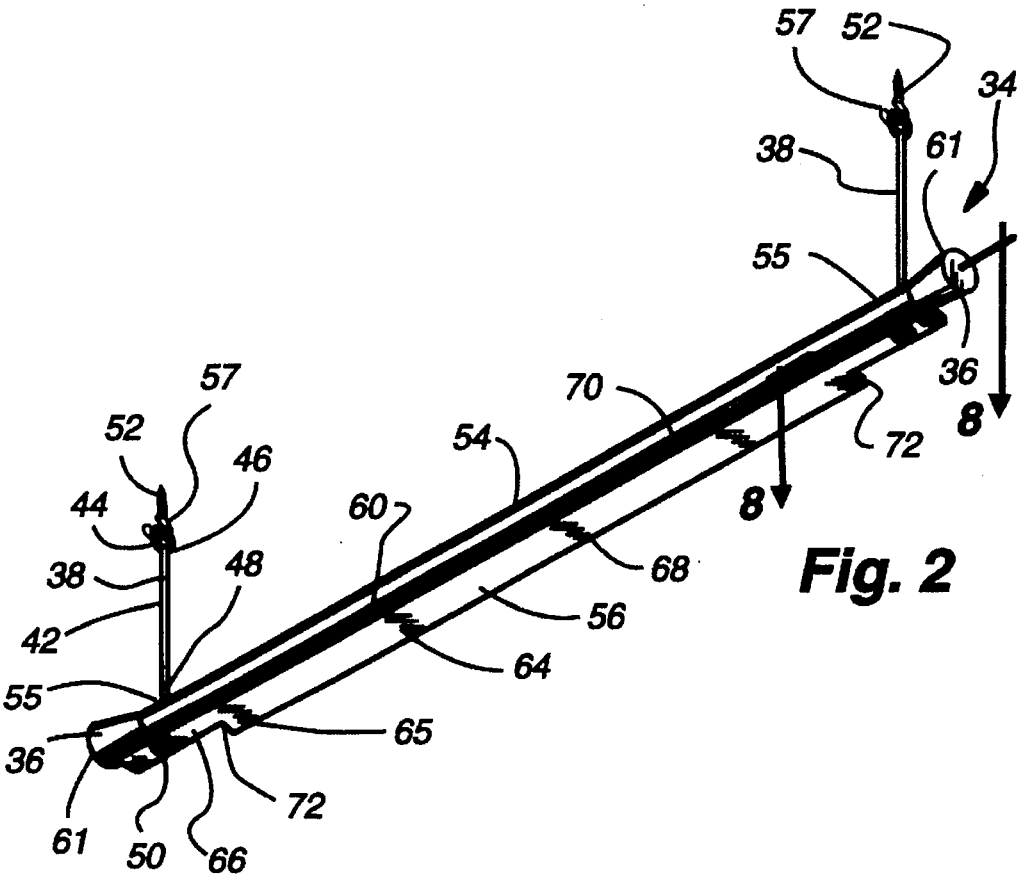
FIG. 2 is an enlarged perspective view of the removal accessory of the present invention, and illustrates a brake, riser and support rods.

Fig. 2: Screw hook 52 is oriented in wrong direction.

Fig. 4: Reference #52 is screw hook, not eyelet.

Fig. 6: Reference #52 is screw hook, not eyelet.

Fig. 7: Screw hook 52 is oriented in wrong direction.

Signed and Sealed this

Third Day of March, 1998

Bruce Lehman

*Attest:*

BRUCE LEHMAN

*Attesting Officer*

*Commissioner of Patents and Trademarks*